US005183339A

United States Patent [19]

Williams

[11] Patent Number: 5,183,339

[45] Date of Patent: Feb. 2, 1993

[54] BAG AND ADJUSTABLE BAG OPENER FRAME

[76] Inventor: Willard J. Williams, P.O. Box 1809, Wilmington, Calif. 90744

[21] Appl. No.: 840,018

[22] Filed: Feb. 24, 1992

[51] Int. Cl.[5] ..... B65D 33/02

[52] U.S. Cl. ..... 383/33; 141/390; 248/99

[58] Field of Search ..... 383/33; 141/316, 390; 15/257.1, 257.6, 257.9; 248/99

[56] References Cited

U.S. PATENT DOCUMENTS

| | | | |
|---|---|---|---|
| 1,459,599 | 6/1923 | Minor | 383/33 |
| 3,747,653 | 7/1973 | Ringer | 15/257.1 |
| 3,934,803 | 1/1976 | Paulus | 383/33 |
| 3,998,415 | 12/1976 | D'Antonio et al. | 15/257.1 |
| 4,006,928 | 2/1977 | Beugin | 248/99 |
| 4,196,880 | 4/1980 | Hynes | 248/99 |
| 4,318,521 | 3/1982 | Martin et al. | 15/257.1 |
| 4,548,372 | 10/1985 | Lutzker | 248/99 |
| 4,615,743 | 10/1986 | Bylenga | 15/257.9 |
| 5,009,378 | 4/1991 | Linsmeyer et al. | 248/99 |
| 5,011,103 | 4/1991 | Hayes et al. | 248/99 |

*Primary Examiner*—Stephen P. Garbe
*Attorney, Agent, or Firm*—Roger A. Marrs

[57] ABSTRACT

A frame is disclosed herein for maintaining the entrance leading into the interior of a bag fully open which has an elongated linear base with a curved member carried between its opposite ends. The ends of both the base and member are joined by an elbow fitting while the member is divided into two portions selectively joined at opposing ends by a friction clamp or the like. The frame is inserted into the mouth of a trash bag and the curved member secured to provide a rigid frame separating the edge marginal region of the bag wall defining the entrance.

1 Claim, 1 Drawing Sheet

BAG AND ADJUSTABLE BAG OPENER FRAME

BACKGROUND OF THE INVENTION

1. Field of the Invention

The present invention relates to the field of devices for opening the entrance leading into the interior of a trash bag, and more particularly to a novel frame for this purpose that is readily handled by the user and manually inserted inside the mouth of the bag so as to bear against the inside of the edge marginal region thereof to maintain the entrance in a temporarily open condition.

2. Brief Description of the Prior Art

In the past, it has been the conventional practice to pick up trash, and particularly yard debris, by raking the debris into a pile for subsequent introduction into a trash bag. In some instances, the trash bag takes the form of a plastic bag which is placed inside a rigid container, such as a barrel, with the upper edge marginal region of the bag folded over the edge of the barrel so that the mouth leading into the interior storage compartment of the bag is maintained open. Then debris can be picked up from the pile and introduced into the storage compartment of the bag. Subsequently, when the bag is loaded, the bag entrance is then sealed and the bag withdrawn from the rigid barrel for eventual disposal Another method involves the user's using one hand to hold the bag edge marginal region in an upward position while gravity maintains the other side of the edge marginal region on the ground as the user uses his other hand to rake the debris into the storage compartment of the bag.

Problems and difficulties have been encountered when using either one of these methods which stem largely from the fact that the former methods employ a rigid barrel which is expensive and represents an item which is not really necessary for the gathering and disposal of the debris. The latter method is highly inefficient since it is difficult to maintain the opening of the bag expanded to permit easy insertion of the debris. Under normal circumstances, the entrance has a tendency to collapse during the raking process which causes a large portion of the debris to miss the bag and fall exteriorly thereof.

Therefore, a long-standing need has existed to provide a novel and economical means for maintaining the entrance of a trash bag open so that the user may readily hold the bag with one hand and transmit debris, trash and other foreign matter into the bag with the other hand.

SUMMARY OF THE INVENTION

Accordingly, the above problems and difficulties are obviated by the present invention which provides a novel bag opener frame that may be readily inserted into the mouth of the trash bag and permitted to expand so as to bear against the inside surface of the edge marginal region defining the bag mouth to maintain the entrance open. In one form of the invention, the bag opener frame includes an elongated base having opposite ends which are secured to opposite ends of a curved member in such a manner that the rigid frame may be inserted into the mouth of the bag and permitted to expand against the inner surface of the entrance edge marginal region. A feature resides in the provision for the curved member to expand by providing the curved member in a pair of segments or portions having one end of each portion joined to the respective ends of the base while the free ends of the curved portions are releasably joined together by a suitable manual frictional clamp. One version of clamp may provide for a series of spaced segments carried on one end of the member portion while the other end includes an annular collar suitable for manual movement over the segments for diameter reduction into frictional contact with the opposing end.

Therefore, it is among the primary objects of the present invention to provide a novel frame for insertable installation inside the mouth or entrance leading into the storage compartment of a trash bag so that the entrance will be maintained open during trash pickup.

Another object of the present invention is to provide a novel rigid frame for insertion into a trash bag so as to maintain the entrance of the bag open while trash and other debris is passed into the bag by any form of trash gathering techniques.

Still a further object of the present invention is to provide a novel trash bag opening device which may be initially inserted into the mouth of the bag and expanded into frictional engagement therewith for temporarily maintaining the opening to the bag in a condition for receiving collected trash.

Another object of the present invention is to provide an inexpensive and easily installed device to maintain the mouth of the trash bag open during a trash gathering and collection procedure whereby the user may use one hand to hold the bag and the other hand to transfer trash or debris from a pile into the storage compartment of the bag.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
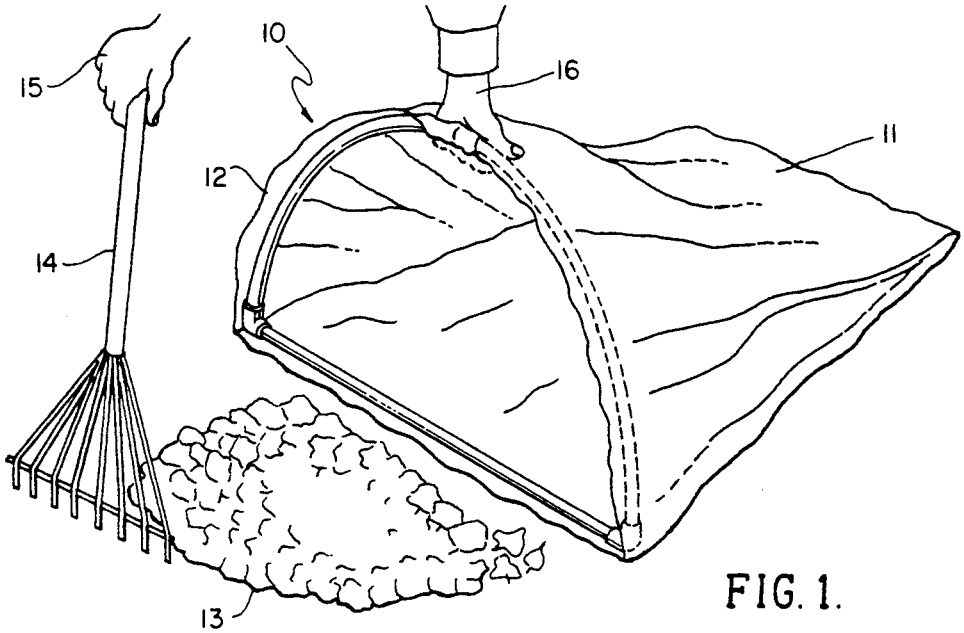
FIG. 1 is a front perspective view of the novel trash bag opening frame illustrated in its operative position.

Referring to FIG. 1, the novel frame of the present invention is indicated in the general direction of arrow 10 and the frame is illustrated as being installed in the mouth of a conventional trash bag 11 having an edge marginal region 12 carried on the continuous wall of the bag itself. The edge marginal region of the bag, indicated by numeral 12, defines an opening leading into the interior storage compartment of the bag into which trash or debris 13 is intended to be placed. In order for the user to properly gather the debris, a rake 14 is utilized and is operated by one hand 15 of the user while his other hand 16 grasps the edge of the bag and the frame 10. Therefore, the entrance into the storage area or compartment of the bag is exposed and the entrance is maintained open during the trash gathering and bag loading procedure.

Figure 2:
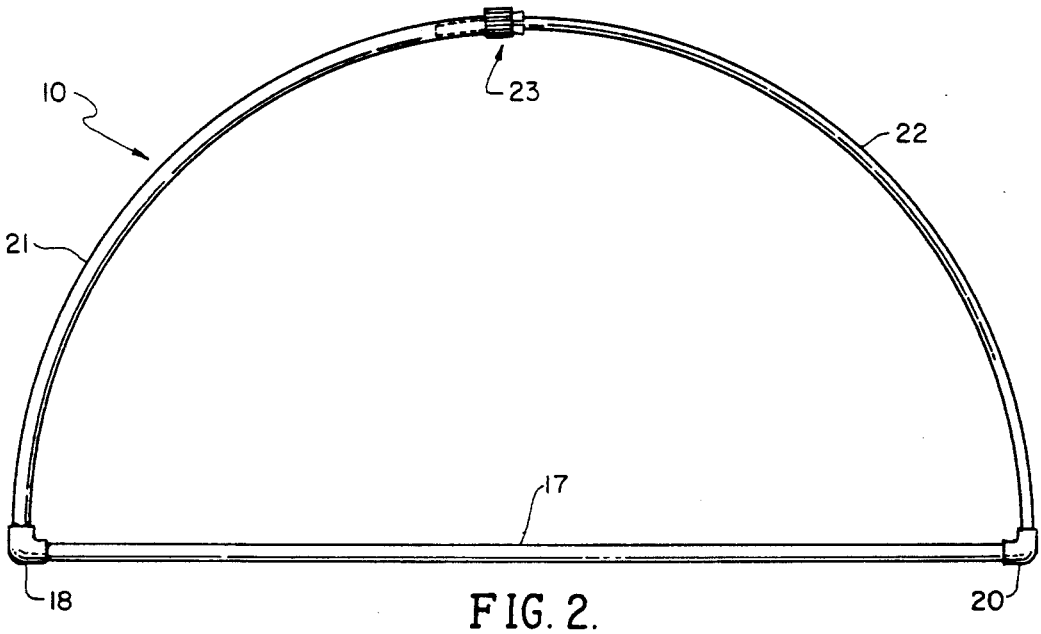
FIG. 2 is an enlarged front elevational view of the novel frame utilized in the embodiment shown in FIG. 1.

Referring now in detail to FIG. 2, it can be seen that the frame 10 includes an elongated rigid base 17 having opposite ends carrying an elbow fitting, such as identified by numerals 18 and 20 respectively. The fittings secure the opposite ends of a curvilinear member having portions 21 and 22 forming a semicircle about the length of the linear base 17. In one form of the invention, the portions 21 and 22 have their opposing and opposite ends releasably connected together by a coupling 23 so that during installation, the opposite ends are uncoupled and the diameter of the semicircular member portions is reduced so that the frame may be fitted into the mouth of the bag 11. Once the frame is so disposed, the opposite ends are joined together by the fitting 23 so that the frame is rigid and the mouth of the bag 11 maintained in an open condition.

Figure 3:
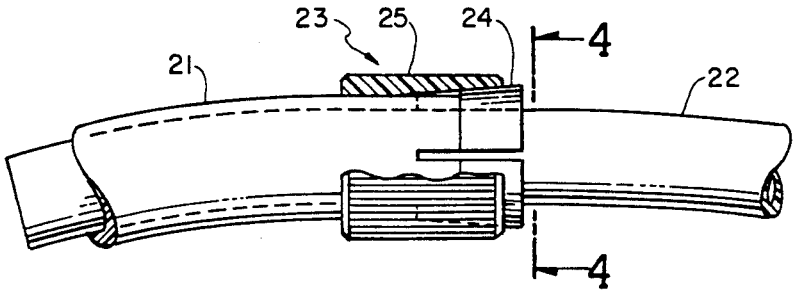
FIG. 3 is an enlarged elevational view, partly in section, of one releasable fastening means for securing the opposite ends of the frame member portions.
Figure 4:
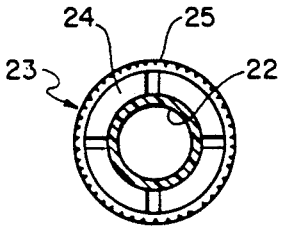
FIG. 4 is a transverse cross-sectional view of the frame shown in FIG. 3 as taken in the direction of arrows 4—4 thereof.

Referring now in detail to FIGS. 2, 3 and 4, one form of closing clamp or fitting takes the form of providing a series of segments, such as segment 24 on the end of the member 21 which are compressed or clamped against the exterior of member portion 22 as a sleeve 25 is pressed over the segments. However, it is to be understood that other types and forms of closure means can be provided which may be of a screw type or employing sliding pressure or other detent and locking mechanisms. Furthermore, it is also envisioned that the base 17 and the arcuate portion may be composed of a single unitary configuration wherein one end of the curved member is attached to one end of the base while the opposite end of the curved member is not attached so that the curved member has a normal bias which outwardly projects to pressably engage against the inside of the bag opening. The spring bias of the integral formation of the curved portion with the linear base maintains the frame rigid and in place after installation.

In view of the foregoing, it can be seen that the adjustable trash bag opener of the present invention may be accommodated to a variety of bag sizes, configurations and diameters. The user may readily insert the base 17 into the mouth of the bag and with the closure means or fitting 23 detached, the member portions 21 and 22 are compressed so as to reduce diameter size until within the mouth of the bag so that when released, the member portions can be fitted against the inside of the edge marginal region of the bag and expanded so as to be taut. At this time, the clamp, closure means or fitting 23 can be locked or latched to maintain the frame rigid. The device may now be used, as illustrated in FIG. 1, with one hand supporting the frame and bag while the other hand employs a rake or other debris-collecting implement.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A trash bag and adjustable bas opener frame comprising:

an elongated rigid linear base having opposite ends;

a curvilinear member having opposite ends with at least one of said member ends secured with a selected one of said base ends;

said member having an outwardly projecting bias normally urging said member away from said base;

said member includes a pair of member portions wherein each portion is secured to an end of said base opposite ends and further provided with opposing terminating ends;

coupling means cooperatively carried on said member portion terminating ends releasably joining said terminating ends together;

elbow joints securing said member opposite ends with said base opposite ends;

said trash bag having an open entrance leading to an internal storage area;

said base and said member portions constituting a frame insertable into said bag entrance and engageable with said bag entrance to maintain said entrance open;

said bag includes an edge marginal region defining said entrance against which said frame bears in response to said normal bias;

adjustment means including telescoping sliding relationship of said member opposite ends operable in combination with said coupling means to selectively establish the length of said member; and said coupling means includes spaced segments and a manual clamp moveable over said segments between a closed and an open position to alternately tighten and release said member portion terminating ends with respect to each other.

* * * * *